US005986228A

United States Patent [19]

Okamoto et al.

[11] Patent Number: 5,986,228

[45] Date of Patent: Nov. 16, 1999

[54] MOVABLE CONTACT UNIT FOR PANEL SWITCH AND PANEL SWITCH USING THE SAME

[75] Inventors: Yuji Okamoto, Tsuyama; Koji Sako, Katsuta-gun, both of Japan

[73] Assignee: Matsushita Electric Industrial Co., Ltd., Osaka, Japan

[21] Appl. No.: 09/249,153

[22] Filed: Feb. 12, 1999

[30] Foreign Application Priority Data

Feb. 13, 1998 [JP] Japan ..... 10-030959

[51] Int. Cl.[6] ..... H01H 13/48; H01H 13/52

[52] U.S. Cl. ..... 200/516; 200/517

[58] Field of Search ..... 200/5 R, 5 A, 200/511–517, 341–345; 400/490, 491, 491.2, 491.3, 495, 495.1

[56] References Cited

U.S. PATENT DOCUMENTS

| | | | |
|---|---|---|---|
| 4,207,448 | 6/1980 | Furusawa et al. | 200/159 B |
| 4,302,647 | 11/1981 | Kandler et al. | 200/159 B |
| 4,336,529 | 6/1982 | Buan | 340/365 R |
| 4,605,828 | 8/1986 | Gostomski, Jr. et al. | 200/5 A |
| 4,671,688 | 6/1987 | Brashears | 400/714 |
| 5,028,752 | 7/1991 | Sanai | 200/341 |
| 5,399,823 | 3/1995 | McCusker | 200/521 |
| 5,557,079 | 9/1996 | Jackson et al. | 200/5 A |
| 5,578,802 | 11/1996 | Palmowski | 200/5 A |

*Primary Examiner*—Michael Friedhofer
*Attorney, Agent, or Firm*—Ratner & Prestia

[57] ABSTRACT

A movable contact unit for a panel switch having (a) a substrate sheet of an insulating material having an electrically conductive layer on an entire upper surface, and provided with a opening at a predetermined position, (b) a dome-like movable contact of a thin resilient sheet metal placed in the opening of the substrate sheet, and (c) a dustproof sheet of an insulation film having flexibility, coated with an adhesive material on its underside, positioned over the opening of the substrate sheet, and adhesively conjoining the substrate sheet around a periphery of the opening and an upper part of the dome-like movable contact with the adhesive material. Also, a panel switch constructed of the movable contact unit placed and adhered on a substrate circuit board having stationary contact on its upper surface in a position such that the dome-like movable contact corresponds to the stationary contact.

21 Claims, 7 Drawing Sheets

MOVABLE CONTACT UNIT FOR PANEL SWITCH AND PANEL SWITCH USING THE SAME

FIELD OF THE INVENTION

The present invention relates to a movable contact unit for panel switch and a panel switch using the same. The panel switch of this invention is utilized in many applications such as actuating panels for numerous kinds of electronic equipment.

BACKGROUND OF THE INVENTION

A movable contact unit for panel switch of the prior art is described hereinafter by referring to a cross sectional side view of FIG. 7A, an exploded perspective view of FIG. 7B, a cross sectional side view of FIG. 8, and a fragmentary cross sectional view of FIG. 9. A dome-like movable contact 1 constructed of a thin resilient sheet metal is placed in each of a plurality of openings 2B provided in a sheet 2 formed of an insulation film coated with adhesive material 2A on its underside surface. The movable contact 1 is adhesively conjoined of its upper surface, and fixed in its position by a dustproof sheet 3 of a flexible insulation film in a size slightly greater than the opening 2B glued over the openings 2B of the sheet 2. Then, a flexible conductive sheet 4 is adhered from the above to constitute the movable contact unit 20 for panel switch.

In the movable contact unit 20 for panel switch having the above-described structure, a release liner 5 is adhered on an underside of the sheet 2 by the adhesive material 2A on the underside of the sheet 2 to cover the openings 2B, in order to prevent dust from entering into the openings 2B of the sheet 2, and to avoid it from sticking to the other movable contact unit 20 while in the transportation and/or storage. When the movable contact unit 20 for panel switch is assembled into an electronic equipment, the release liner 5 adhered on the underside of the sheet 2 is removed first, and the movable contact unit 20 is adhered with the adhesive material 2A on the underside of the sheet 2 by overlaying it on a substrate circuit board 8 having a plural pair of electrically independent stationary contacts 6 and 7 located in positions corresponding to an outer periphery 1A and a top center area 1B of the individual dome-like movable contact 1. A panel switch 21 depicted in the cross sectional side view of FIG. 8 is thus completed, when an actuating board 10 made of an elastic rubber or the like material and formed integrally with an actuating button 9 for depressing each of the dome-like movable contact 1 is mounted.

The conductive sheet 4 on the top surface of the movable contact unit 20 of the panel switch is provided for the purposes of suppressing an extraneous emission of electromagnetic waves from actuating portions of the electronic equipment mounted with the movable contact unit 20, and for draining static electricity, which flows into the movable contact unit 20 from the actuating button 9, to a conductive part for grounding. For this reason, the movable contact unit 20 of the panel switch is usually adhered on the substrate circuit board 8 with an edge of the movable contact unit 20 folded back in a manner to make the conductive sheet 4 electrically in contact with a grounding circuit part 11 deposited on the substrate circuit board 8, as shown in the fragmentary cross sectional view of FIG. 9.

Referring now to FIG. 8, the panel switch 21 operates in a manner as described hereinafter. When the actuating button 9 is depressed, the pressure is transmitted to the dome-like movable contact 1 positioned over the stationary contact 6 via a projection 9A of the actuating button 9, the conductive sheet 4 and the dustproof sheet 3. If the pressure exceeds a predetermined force, the dome-like movable contact 1 is flipped with a tactile response, and the top center portion 1B touches to the stationary contact 7 on the substrate circuit board 8, thereby making an electrical connection between the stationary contacts 6 and 7 through the dome-like movable contact 1. When the depressing force is removed from the actuating button 9, the dome-like movable contact 1 is flipped back to its original shape by its own resiliency to open electrically between the stationary contacts 6 and 7.

As described in the foregoing, the movable contact unit 20 for panel switch and the panel switch 21 using the same have the structure, wherein an upper side of the dome-like movable contact 1 is overlaid with two layers of sheets, i.e. the conductive sheet 4 for a countermeasure against the extraneous emission of electromagnetic waves and the static electricity, and the dustproof sheet 3. Due to this structure, a discernible feel of actuation, or a tactile response, of the dome-like movable contact 1 is somewhat reduced, since the depressing force and the resiliency of the dome-like movable contact 1 are absorbed by the conductive sheet 4 and the dustproof sheet 3. Although a thickness of the two layers needs to be reduced in order to improve the feel of actuation, there has been a problem that it requires a high level of adhering technique and expensive assembling apparatuses in manufacturing the dome-like movable contacts 1, since the thinner they are the more difficult they become to handle.

The present invention is intended to improve the above problem, and it aims at providing a movable contact unit for panel switch and a panel switch using the same that suppresses an extraneous emission of electromagnetic waves and reduces an adverse effect of static electricity, yet gives an excellent feel of actuation.

SUMMARY OF THE INVENTION

A movable contact unit for panel switch of the present invention comprises:

(1) a substrate sheet made of an insulating material having an electrically conductive layer over an entire upper surface, and provided with a opening in a predetermined location;

(2) a dome-like movable contact constructed of a thin resilient sheet metal placed in the opening of the substrate sheet; and (3) a dustproof sheet made of an insulation film having flexibility and coated with an adhesive material on its underside, positioned over the opening of the substrate sheet, and adhesively conjoining a periphery of the opening of the substrate sheet and an upper portion of the dome-like movable contact with the adhesive material. Also, a panel switch of the present invention is constructed by placing and adhering the movable contact unit over a substrate circuit board having stationary contact on its upper surface, so that the dome-like movable contact is arranged in a position corresponding to the stationary contact.

The above-described structure enables the electrically conductive layer provided on the upper surface of the substrate sheet to suppress an extraneous emission of electromagnetic waves, and to drain static electricity to a conductive grounding part of an adopted electronic equipment via the electrically conductive layer. Also, the movable contact unit and a panel switch using the same having an excellent feel of actuation can be realized with a limited number of components, since they are constructed of only one layer of the dustproof sheet to cover the dome-like movable contact.

Besides, the substrate sheet can be formed of an electrically conductive sheet adhered over a surface of an insulation sheet in lieu of the electrically conductive layer. And the insulation sheet only of the substrate sheet is provided with a through hole in a position different from the opening, which houses the dome-like movable contact. Since a part of lower surface of the electrically conductive sheet exposes from the through hole, the electrically conductive sheet can be grounded easily by making the exposed part of the electrically conductive sheet to contact with a grounding circuit part of the substrate circuit board disposed beneath it.

DESCRIPTION OF THE PREFERRED EMBODIMENTS

Figure 1A:
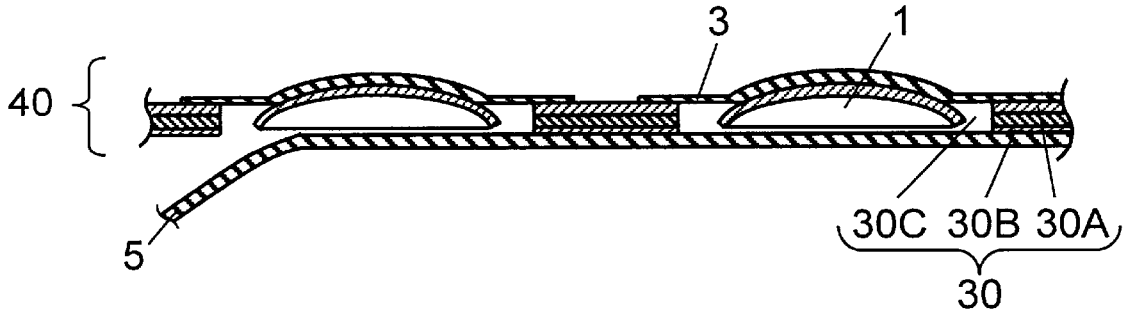
FIG. 1A is a cross sectional side view depicting a movable contact unit for panel switch of a first exemplary embodiment of the present invention.
Figure 1B:
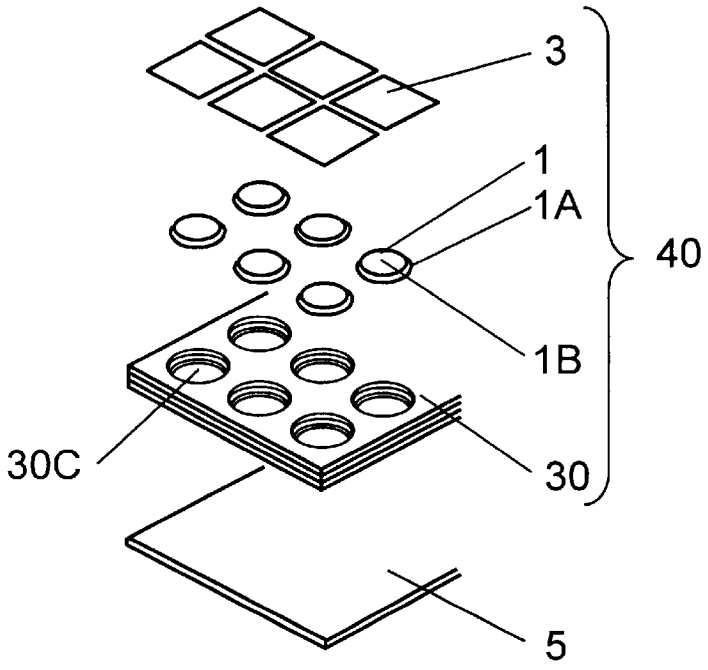
FIG. 1B is an exploded perspective view depicting the movable contact unit of FIG. 1A.

Preferred exemplary embodiments of the present invention are now described by referring to FIG. 1 through FIG. 6. In the following exemplary embodiments, any components having the same structure as those already described in the prior art technology are assigned with the same reference numerals and their detailed descriptions are omitted.

First Exemplary Embodiment

A movable contact unit for panel switch and a panel switch using the same of a first exemplary embodiments of the present invention are described by referring to FIGS. 1A, 1B, 2 and 3. A substrate sheet 30 made of an insulation material is formed with a layer of silver 30A on its upper surface by printing, and also coated on its lower surface with an adhesive material 30B. The substrate sheet 30 is provided with a opening 30C in a predetermined location, and a dome-like movable contact 1 constructed of a thin resilient sheet metal is placed in the opening 30C. A dustproof sheet 3 made of an insulation film having flexibility in a size slightly greater than the opening 30C, and coated with an adhesive material on its lower surface, is adhered on the upper surface of the substrate sheet 30 to cover each of the openings 30C, and adhesively conjoins an upper surface of the dome-like movable contact 1 at the same time.

Incidentally, the movable contact unit 40 for panel switch of the above-described structure is adhered with a release liner 5 by the adhesive material 30B on the lower surface of the substrate sheet 30 for the purpose of preventing dust, etc. from entering into the openings 30C of the substrate sheet 30 during transportation and storage, in the same manner as in the case of the prior art technique.

Figure 2:
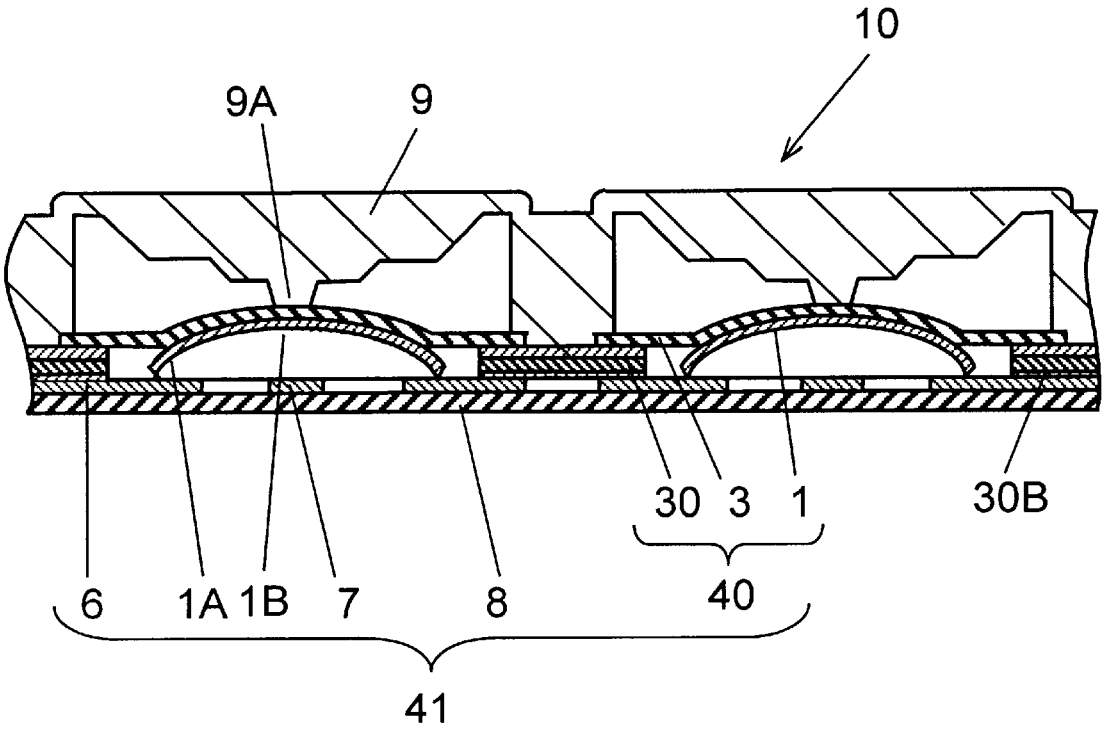
FIG. 2 is a cross sectional side view of a panel switch using the movable contact unit of FIGS. 1A and 1B.
Figure 3:
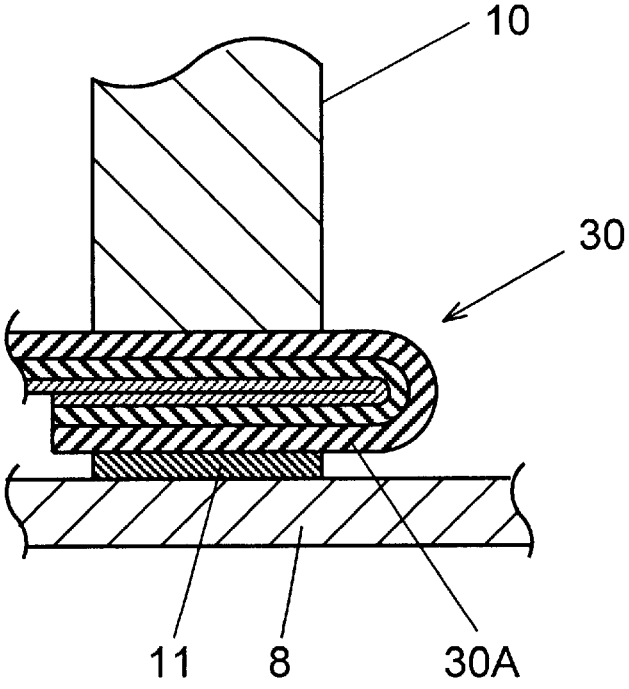
FIG. 3 is a fragmentary cross sectional view depicting a connecting portion between a silver layer of the movable contact unit of FIG. 2 and a grounding circuit part of a substrate circuit board.

Referring now to FIGS. 2 and 3, the movable contact unit 40 for panel switch is assembled into a predetermined electronic equipment as described. First, the release liner 5 adhered on the underside of the movable contact unit 40 is removed. A substrate circuit board 8 is provided with electrically independent stationary contacts 6 and 7. The movable contact unit 40 is then placed and adhered with the adhesive material 30B on the underside of the substrate sheet 30 over the substrate circuit board 8 having a plural pair of the electrically independent stationary contacts 6 and 7 each located in positions corresponding to an outer periphery 1A and a top center part 1B of the individual dome-like movable contact 1. A panel switch 41 depicted in a cross-sectional side view of FIG. 2 is now constructed, when an actuating board 10 made of an elastic rubber or the like material formed integrally with an actuating button 9 is mounted thereafter. During this assembling process, the silver layer 30A on the upper surface of the substrate sheet 30 is electrically connected with a grounding circuit part 11 deposited on the substrate circuit board 8 by folding back an edge of the movable contact unit 40 in the same way as that of the prior art, as shown in a fragmentary cross sectional view of FIG. 3. With regard to the grounding, the stationary contact 6, with which the periphery 1A of the dome-like movable contact 1 stays in contact at all the time, is in the same potential with the grounding circuit part 11, i.e., it is grounded to the earth, in addition to the foregoing.

The panel switch 41 operates in a manner as described below. When the actuating button 9 of the actuating board 10 depicted in FIG. 2 is depressed, the pressure is applied to the dome-like movable contact 1 positioned on the stationary contact 6 via a projection 9A of the actuating button 9 and the dustproof sheet 3. If the pressure exceeds a predetermined force, the dome-like movable contact 1 is flipped with a tactile response, and the top center part 1B touches the stationary contact 7 on the substrate circuit board 8, so as to make an electrical connection between the stationary contacts 6 and 7. When the depressing force is removed from the actuating button 9, the dome-like movable contact 1 is flipped back to its original shape by its resiliency, so as to electrically open between the stationary contacts 6 and 7.

In the electronic equipment provided with the panel switch 41 of the present exemplary embodiment, the silver layer 30A formed on the entire upper surface of the substrate sheet 30 is electrically connected with the grounding circuit part 11 of the substrate circuit board 8, and additionally, the periphery 1A of the dome-like movable contact 1 placed in the opening 30C of the substrate sheet 30 is electrically connected at all the time with the stationary contact 6 having the same potential with the grounding circuit part 11. In a word, it is in such configuration that nearly an entire surface of the movable contact unit 40 of the panel switch is grounded, so that an extraneous emission of electromagnetic waves from the surface of the panel switch 41 can be suppressed effectively. In addition, a static electricity flowing into the movable contact unit 40 from the actuating button 9, etc. is drained toward the grounding circuit part 11 of the substrate circuit board 8, after it is discharged to the silver layer 30A on the substrate sheet 30 via the dustproof sheet 3, in the same way as in the case of the prior art. Since the movable contact unit 40 and the panel switch 41 using the same of the present embodiment have the structure, wherein the top surface of the dome-like movable contact 1 is covered only with a thin layer of the dustproof sheet 3 having a flexibility, a substantially better feel of actuation can be realized in a depressing operation as compared to the conventional panel switch.

As has been described, the movable contact unit 40 for panel switch and the panel switch 41 using the same in the present exemplary embodiment are capable of attaining a preventive measure for the extraneous emission of electromagnetic waves and the static electricity, and yet having an excellent feel of actuation, with a simple structure and a limited number of structural components.

Incidentally, the silver layer 30A formed by printing as an electrically conductive layer on the upper surface of the substrate sheet 30 needs not be limited to noble metal of gold or silver. If the electrically conductive layer is formed using copper, nickel, indium, carbon, or mixture of these elements for example, by a printing method such as silk screening or the like, low cost products can be realized with a continuous production from formation of the electrically conductive layer to completion of the movable contact units for panel switches. Moreover, the process of formation is not limited to a printing method, and the layer of an electrically conductive material or an electrically conductive metal can be formed by a vacuum deposition process such as the evaporation method, the sputtering method, and the like, as needed. If a thin film layer of aluminum, gold, silver, copper, nickel, indium, indium-tin oxide, carbon, a mixture of these elements or the like material is deposited by the evaporation method, the ion-plating method, the sputtering method, or the chemical vapor deposition method, the extraneous emission of electromagnetic waves can be suppressed more effectively.

Figure 4A:
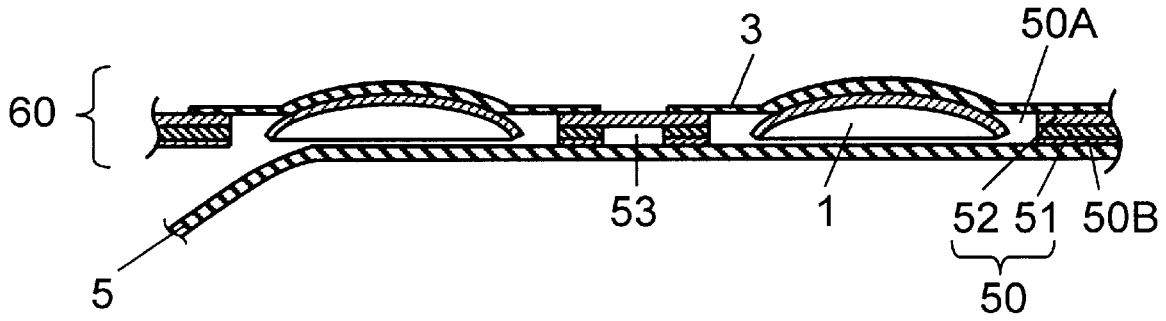
FIG. 4A is a cross sectional side view depicting a movable contact unit for panel switch of a second exemplary embodiment of the present invention.
Figure 4B:
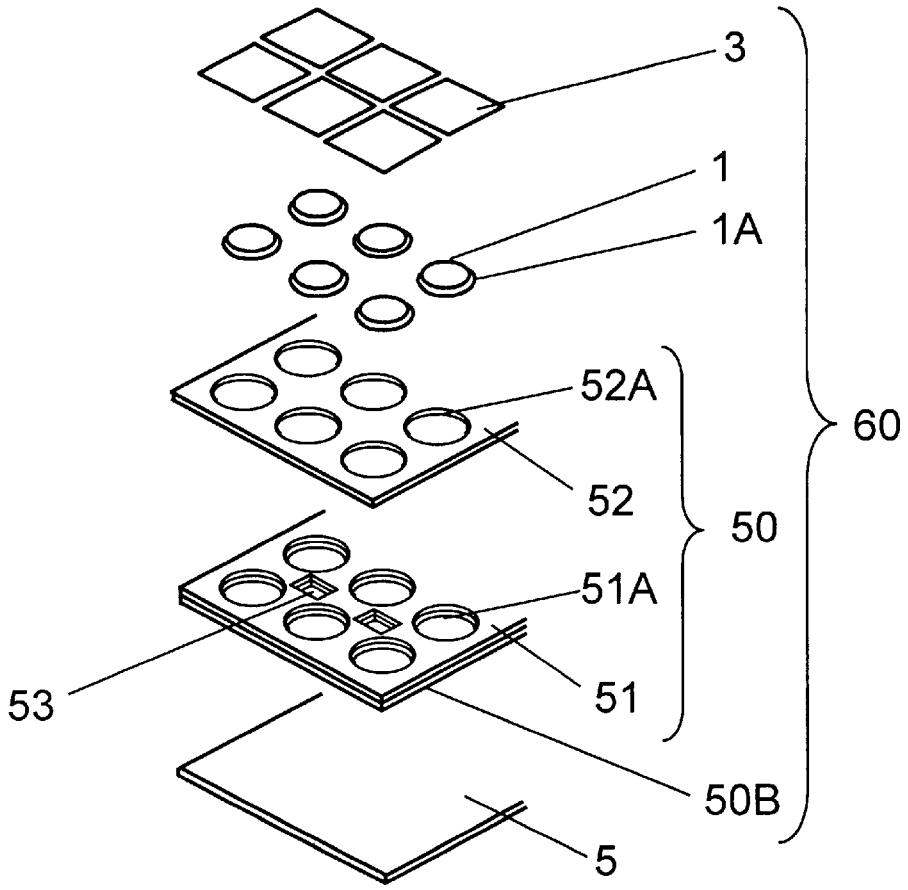
FIG. 4B is an exploded perspective view depicting the movable contact unit of FIG. 4A.
Figure 5:
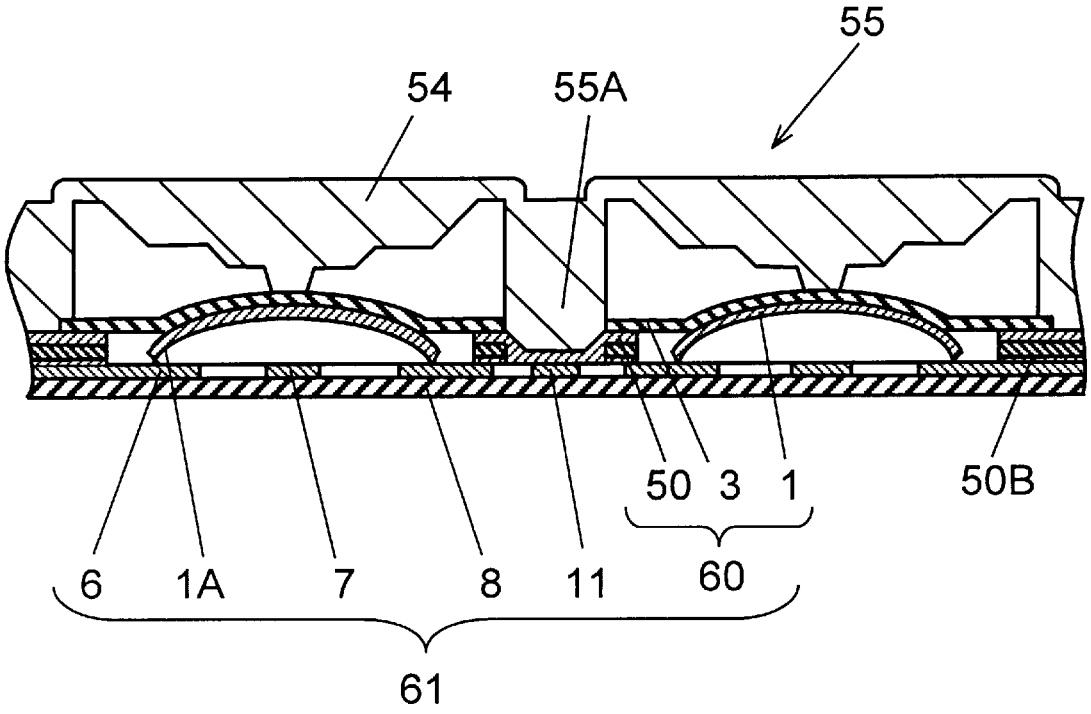
FIG. 5 is a cross sectional side view of a panel switch using the movable contact unit of FIGS. 4A and 4B.

The electrically conductive layer 30A on the upper surface of the substrate sheet 30 can also be an electrically conductive sheet adhered on a layer of an insulation sheet. Production and delivery of the movable contact units 60 for panel switches can be promptly carried out by using a predetermined insulation sheet 51 and an electrically conductive sheet 52 selected and adhered as shown in FIG. 4 according to the required specifications for a thickness, an extraneous emission level of electromagnetic waves, a charge potential of static electricity, etc. of the movable contact units 60 given by a manufacturer of the electronic equipment.

Although the present embodiment as described above is an exemplar in that the silver layer 30A is connected to the grounding circuit part 11 by folding back an edge of the movable contact unit 40 for panel switch when the movable contact unit 40 is adhesively mounted on an adopted equipment, it is needless to mention that the method of connecting them is not limited to the above.

Second Exemplary Embodiment

A movable contact unit for panel switch and a panel switch using the same of a second exemplary embodiments of the present invention are described hereinafter by referring to FIGS. 4A. 4B and 5. A substrate sheet 50 is formed by adhering an insulation sheet 51 and an electrically conductive sheet 52 having a opening 51 A and a opening 52A in an approximately equal diameter at a location for placing the dome-like movable contact 1, in a manner to position the electrically conductive sheet 52 on top of the insulation sheet 51. The dome-like movable contact 1 is placed in a opening 50A consisting of the opening 51A and the opening 52A, and an upper surface of it is adhesively conjoined with a dustproof sheet 3 having a flexibility, which is adhered over the openings 50A of the substrate sheet 50. The insulation sheet 51 is provided with a through hole 53 in a position different from the opening 51A in which the dome-like movable contact 1 is placed, and a part of the electrically conductive sheet 52 is exposed in the through hole 53.

In the movable contact unit 60 for panel switch of the above-described structure, a release liner 5 is adhered with the adhesive material 50B coated on the lower surface of the insulation sheet 51 of the substrate sheet 50, when it is transported and stored, in the same manner as in the case of the prior art.

When the movable contact unit 60 for panel switch of the present exemplary embodiment is assembled into a predetermined electronic equipment, the release liner 5 adhered on the underside of the substrate sheet 50 is removed. The movable contact unit 60 is then placed and adhered over a substrate circuit board 8 having stationary contacts 6 and 7 located in positions corresponding to the dome-like movable contact 1 in the same manner as that of the prior art. On the other hand, an actuating board 55 made of an elastic rubber or the like material formed integrally with an actuating button 54, which is to be mounted thereafter, is also provided integrally with a boss 55A protruding downwardly in a manner to correspond with the position of the through hole 53 provided in the insulation sheet 51 of the substrate sheet 50. When the actuating board 55 is assembled over the movable contact unit 60, as shown in the cross sectional side view of the panel switch 61 in FIG. 5, the boss 55A of the actuating board 55 presses down the part of the electrically conductive sheet 52 exposed in the through hole 53 of the insulation sheet 51. Thus, the boss 55A presses the part of the electrically conductive sheet 52 against a grounding circuit part 11 deposited on the substrate circuit board 8 to make an electrical connection between them.

Accordingly, the movable contact unit 60 for panel switch and the panel switch 61 using the same in the present exemplary embodiment are able to make a connection of the electrically conductive sheet 52 on the upside of the substrate sheet 50 to the grounding circuit part 11 deposited on the substrate circuit board 8, easily and reliably with less assembling process. In addition, the panel switch 61 can attain the same function and effect as with the panel switch described in the first exemplary embodiment, by maintaining the stationary contact 6 on the substrate circuit board 8, which is in contact at all the time with the outer periphery 1A of the dome-like movable contact 1, to be in the same potential with the grounding circuit part 11.

Also, since the substrate sheet 50 consists of the insulation sheet 51 adhered with the electrically conductive sheet 52, the production and delivery of the movable contact units 60 for panel switches can be promptly carried out by selecting a predetermined insulation sheet 51 and electrically conductive sheet 52 according to the required specifications for a thickness, an extraneous emission level of electromagnetic waves, a charge potential of static electricity, etc. given by a manufacturer of the electronic equipment, in the same way as the first exemplary embodiment.

Figure 6:
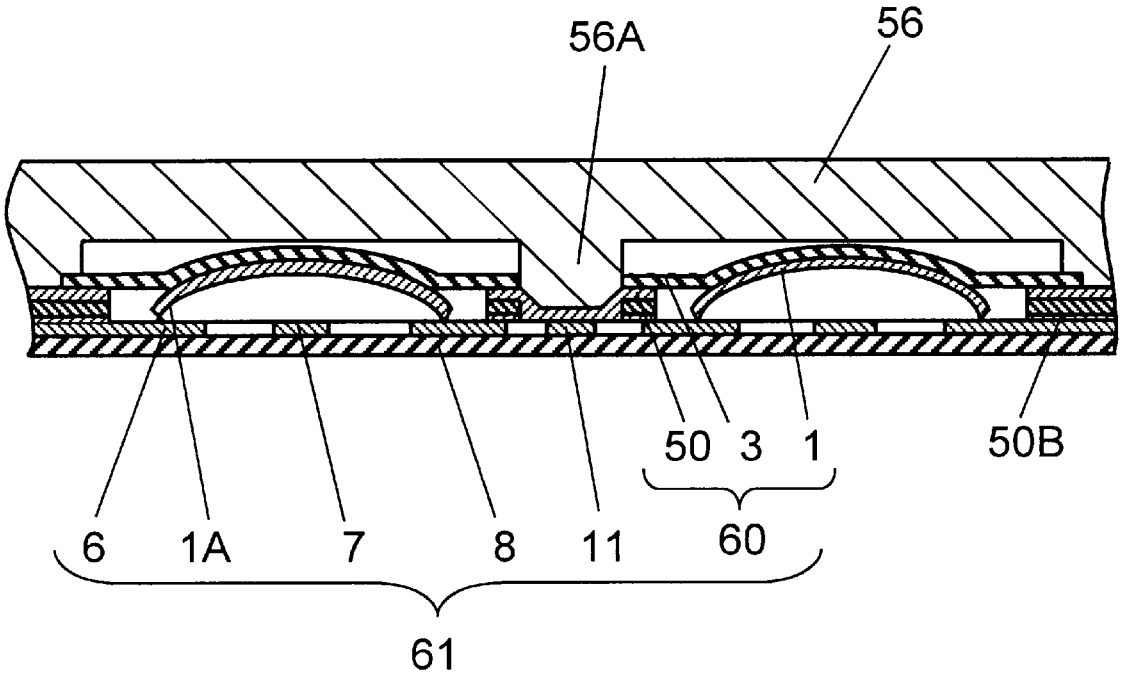
FIG. 6 is a cross sectional side view of a panel switch of another structure using the movable contact unit of FIGS. 4A and 4B.
Figure 7A:
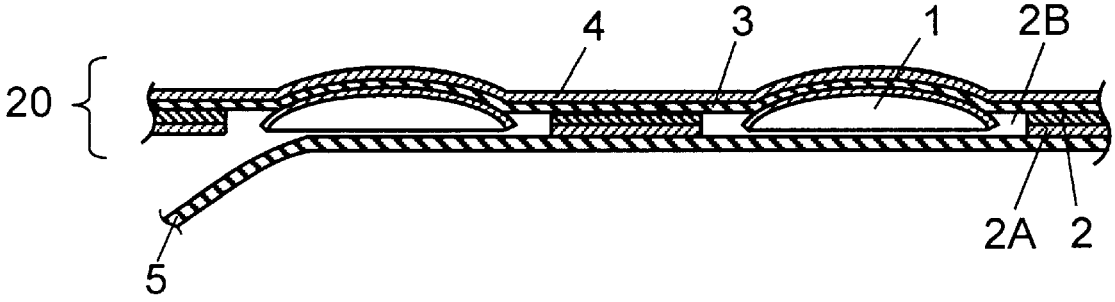
FIG. 7A PRIOR ART
FIG. 7A is a cross sectional side view depicting a movable contact unit for panel switch of the prior art.
Figure 7B:
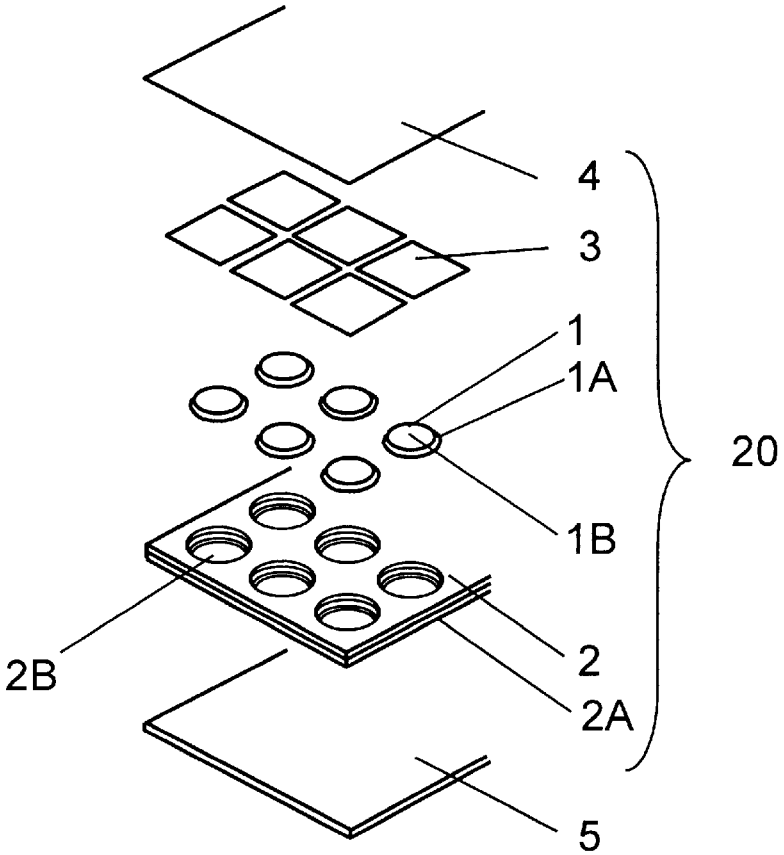
FIG. 7B PRIOR ART
FIG. 7B is an exploded perspective view of the movable contact unit of FIG. 6A.
Figure 8:
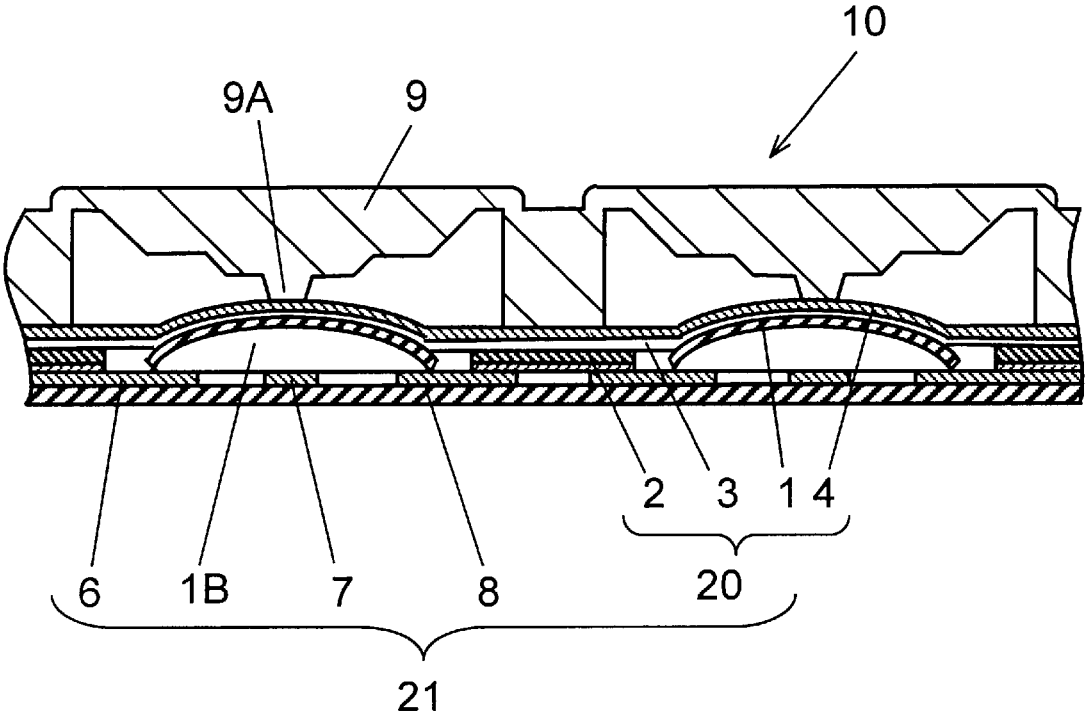
FIG. 8 PRIOR ART
FIG. 8 is a cross sectional side view of a panel switch using the movable contact unit of FIGS. 7A and 7B.
Figure 9:
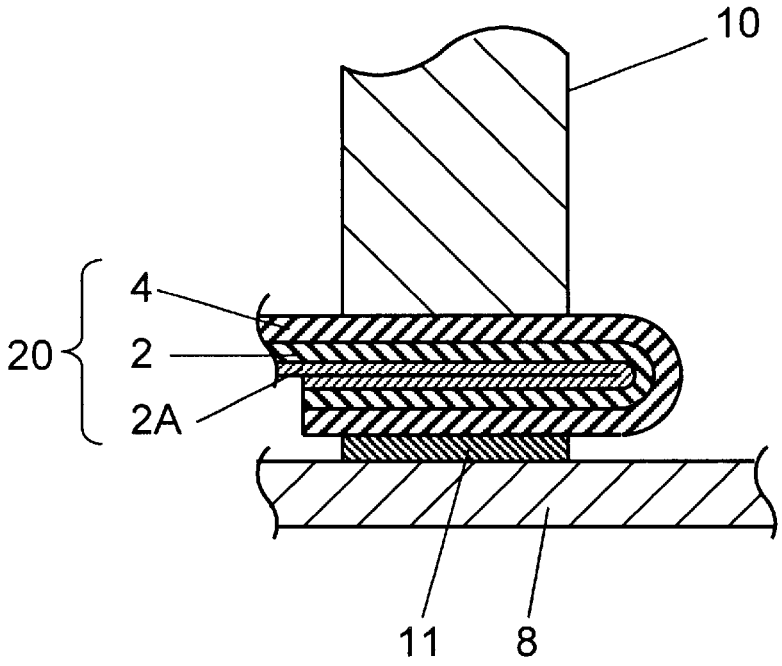
FIG. 9 PRIOR ART
FIG. 9 is a fragmentary cross sectional view depicting a connecting portion between an electrically conductive sheet of the movable contact unit of FIG. 8 and a grounding circuit part of a substrate circuit board.

Although the described embodiment is a panel switch having the structure wherein a part of the electrically conductive sheet 52 exposed in the through hole 53 of the insulation sheet 51 is pressed down with the boss 55A protruding downwardly from the actuating board 55 provided with the integrally formed actuating button 54, the same function and effect can be attained with a structure, as shown in FIG. 6, in that the part of the electrically conductive sheet 52 exposed in the through hole 53 of the insulation sheet 51 is pressed down with a boss 56A on an outer enclosure 56 instead of the actuating board 55, as a matter of course.

What is claimed is:

1. A movable contact unit for a panel switch comprising:

(1) a substrate sheet including an insulating material with an electrically conductive layer at an upper surface of said substrate sheet, and said substrate sheet provided with a opening in a predetermined location thereof;

(2) a dome-like movable contact of a thin resilient sheet metal in said opening of said substrate sheet; and (3) a dustproof sheet of an insulation film having flexibility, coated with an adhesive material on an underside thereof, positioned over said opening of said substrate sheet, and adhesively conjoining said substrate sheet along a periphery of said opening and an upper part of said dome-like movable contact.

2. The movable contact unit for a panel switch according to claim 1, wherein said electrically conductive layer at the upper surface of said substrate sheet comprises a printed layer of an electrically conductive material.

3. The movable contact unit for a panel switch according to claim 2, wherein said electrically conductive material comprises one of gold, silver, copper, nickel, indium, carbon, and compositions thereof.

4. The movable contact unit for a panel switch according to claim 1, wherein said electrically conductive layer on the upper surface of said substrate sheet is formed of a thin layer of an electrically conductive material.

5. The movable contact unit for a panel switch according to claim 4, wherein said electrically conductive layer is formed of an electrically conductive material by a vacuum deposition process.

6. The movable contact unit for a panel switch according to claim 5, wherein said electrically conductive material comprises one of aluminum, gold, silver, copper, nickel, indium, indium-tin oxide, or carbon.

7. The movable contact unit for a panel switch according to claim 1, wherein said substrate sheet comprises an electrically conductive sheet adhered to an upper surface of an insulation sheet.

8. The movable contact unit for a panel switch according to claim 7, wherein said insulation sheet of said substrate sheet further comprises a through hole in a position different from said opening for the dome-like movable contact, and a lower surface of said electrically conductive sheet is exposed in said through hole.

9. A panel switch comprising:

(1) a substrate sheet including an insulating material with an electrically conductive layer at an upper surface of said substrate sheet, and said substrate sheet provided with a opening in a predetermined location thereof;

(2) a dome-like movable contact of a thin resilient sheet metal in said opening of said substrate sheet;

(3) a dustproof sheet of an insulation film having flexibility, coated with an adhesive material on an underside thereof, positioned over said opening of said substrate sheet, and adhesively conjoining said substrate sheet along a periphery of said opening and an upper part of said dome-like movable contact; and (4) a substrate circuit board having a stationary contact at an upper surface thereof, and said substrate circuit board disposed so that said stationary contact is in corresponding position to said dome-like movable contact.

10. The panel switch according to claim 9, wherein said electrically conductive layer on the upper surface of the substrate sheet comprises a printed layer of an electrically conductive material.

11. A panel switch according to claim 10, wherein said substrate circuit board further comprises a grounding circuit part, and said electrically conductive layer on the upper surface of said substrate sheet is connected to said grounding circuit part.

12. The panel switch according to claim 9, wherein said electrically conductive layer on the upper surface of said substrate sheet comprises a thin layer of an electrically conductive material.

13. A panel switch according to claim 12, wherein said substrate circuit board further comprises a grounding circuit part, and said electrically conductive layer on the upper surface of said substrate sheet is connected to said grounding circuit part.

14. The panel switch according to claim 9, wherein said substrate sheet comprises an electrically conductive sheet adhered to an upper surface of an insulation sheet.

15. The panel switch according to claim 14, wherein said substrate circuit board further comprises a grounding circuit part, only said insulation sheet of said substrate sheet further comprises a through hole in a position different from said opening for the dome-like movable contact, and a lower surface of said electrically conductive sheet exposed in said through hole is connected to said grounding circuit part.

16. The panel switch according to claim 15, further comprising an actuating board formed integrally with an actuating button having a projection, wherein said electrically conductive sheet is electrically connected to said grounding circuit part by pressing a lower surface of said electrically conductive sheet exposed in said through hole against said grounding circuit part of the substrate circuit board with said projection of said actuating board.

17. The panel switch according to claim 15, further comprising an outer enclosure having a projection, wherein said electrically conductive sheet is electrically connected to said grounding circuit part by pressing a lower surface of said electrically conductive sheet exposed in said through hole against said grounding circuit part of the substrate circuit board with said projection of said outer enclosure.

18. A panel switch according to claim 14, wherein said substrate circuit board further comprises a grounding circuit part, and said electrically conductive layer on the upper surface of said substrate sheet is connected to said grounding circuit part.

19. A panel switch according to claim 9, wherein said substrate circuit board further comprises a grounding circuit part, and said electrically conductive layer on the upper surface of said substrate sheet is connected to said grounding circuit part.

20. The panel switch according to claim 9, wherein said dome-like movable contact is electrically connected to a grounding circuit part provided on said substrate circuit board by maintaining an outer periphery thereof in contact with said stationary contact on the substrate circuit board.

21. The panel switch according to claim 9, wherein said substrate sheet further comprises an adhesive material on an underside thereof, and said substrate sheet and said substrate circuit board are fixed together by said adhesive material on the underside of said substrate sheet.

* * * * *